United States Patent [19]

Lenk

[11] 3,940,075

[45] Feb. 24, 1976

[54] WINDING MACHINE

[75] Inventor: Erich Lenk, Remscheid, Germany

[73] Assignee: Barmag Barmer Maschinenfabrik Aktiengesellschaft, Wuppertal, Germany

[22] Filed: Jan. 15, 1974

[21] Appl. No.: 433,435

[30] Foreign Application Priority Data

Jan. 17, 1973 Germany ..... 2302095

[52] U.S. Cl. ..... 242/18 PW; 242/43 R; 242/157 R

[51] Int. Cl.[2] ..... B65H 54/34

[58] Field of Search ..... 242/18 PW, 18 G, 18 A, 242/43, 157 R

[56] References Cited

UNITED STATES PATENTS

| | | | |
|---|---|---|---|
| 2,395,890 | 3/1946 | Lodge | 242/18 PW UX |
| 2,517,625 | 8/1950 | Bauer et al. | 242/18 PW |
| 3,075,715 | 1/1963 | Hensen et al. | 242/18 PW |
| 3,090,570 | 5/1963 | Cunningham et al. | 242/18 G |
| 3,109,602 | 11/1963 | Smith | 242/18 G |
| 3,276,719 | 10/1966 | Stetz | 242/157 R |
| 3,310,247 | 3/1967 | Emery | 242/18 A |
| 3,717,310 | 2/1973 | Ritter | 242/18 PW |

*Primary Examiner*—Stanley N. Gilreath
*Attorney, Agent, or Firm*—Johnston, Keil, Thompson & Shurtleff

[57] ABSTRACT

A winding machine in which incident to the production of a bobbin a thread reserve is built up axially adjacent to the bobbin. The machine has a traversing thread guide with a thread-guiding slot and with slanted side faces, and an auxiliary thread guide with an arm which extends into the thread traversal plane at an angle pointing in the direction of the thread reserve zone. The arm is moved, generally rectilinearly and parallel to the path of the traversing thread guide, so as to lift the thread out of the slot of the traversing thread guide when the latter moves, in the direction away from the thread reserve zone, against the auxiliary thread guide. Passing of the thread between the two guides is facilitated by making the two side faces of the traversing thread guide of different lengths. The disclosed design is of particular advantage where a waste winding is to be built up in the principal winding range prior to the formation of the reserve winding.

8 Claims, 8 Drawing Figures

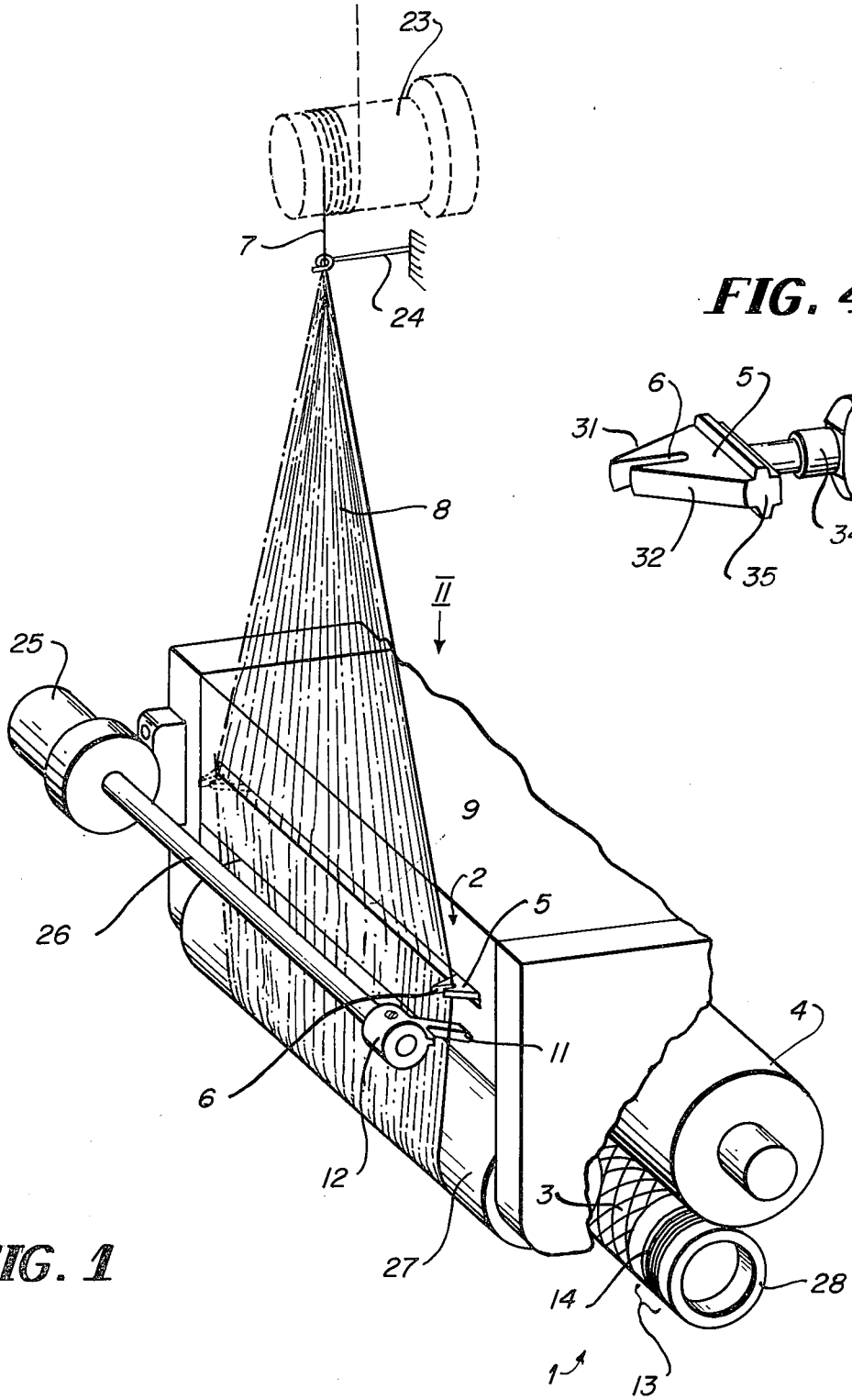
FIG. 1
FIG. 4
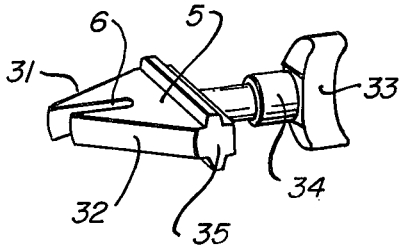

FIG. 5a
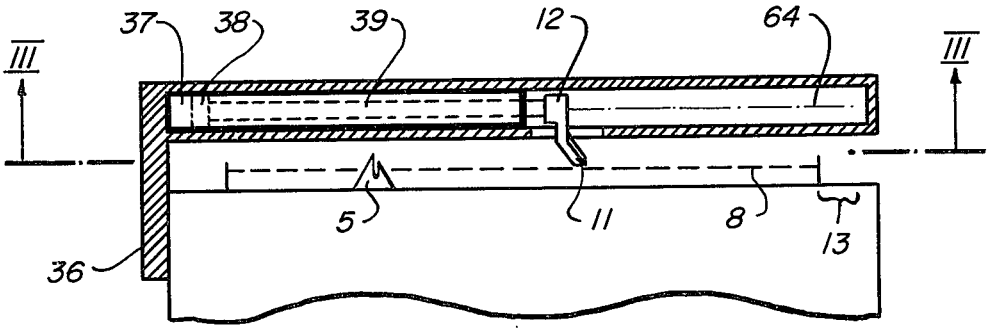
FIG. 5b
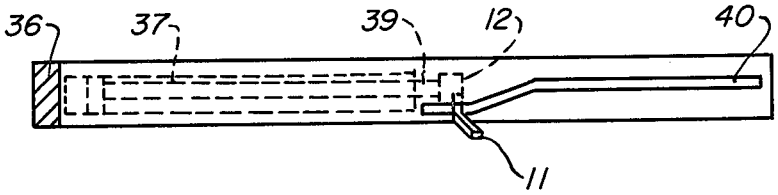
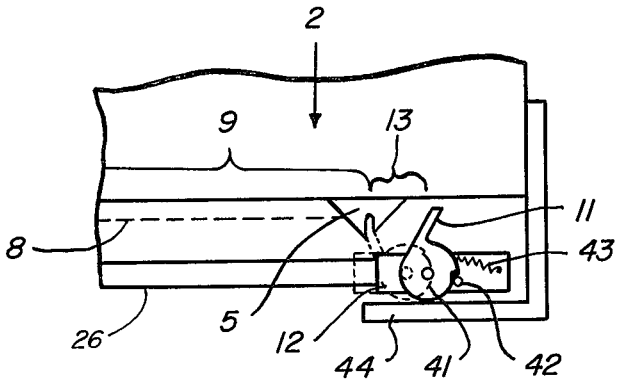
FIG. 6

WINDING MACHINE

The invention generally relates to winding machines and, more particularly, to winding machines, known per se, in which incident to the production of bobbins on bobbin- or spool-sleeves, a thread reserve is built up adjacent to the bobbin prior to the winding of the bobbin proper. This thread reserve makes it possible to connect the end of the bobbin with the beginning of the following bobbin prior to completion of the unwinding operation, thereby facilitating an uninterrupted drawing off of the thread or yarn.

The thread reserve is typically formed by clamping and capturing the incoming thread in a suitable thread capturing device either on the sleeve carrier or between the sleeve carrier and the sleeve or in a groove formed in the sleeve; by depositing the thread in the initial phase of the winding operation by means of an auxiliary thread guide in a range of the sleeve which lies outside of the spool range; and by then releasing the thread from the auxiliary thread guide and turning it over to the main traversing thread guide which then takes over the depositing of the thread to form the bobbin proper. In this connection reference is made to U.S. Pat. applications, Ser. No. 258,869, filed by H. Schippers on June 1, 1972, now U.S. Pat. 3,814,338 and Ser. No. 175,609, filed by K. Bauer et al on Aug. 21, 1971, now U.S. Pat. 3,792,818.

Especially in connection with synthetic fibers which are received in freshly spun condition and are to be wound in the form of a crosswound bobbin by means of a drive roller, it has become desirable first to lay down on the bobbin sleeve a padding or "waste" winding consisting of a few layers of thread deposited over the entire bobbin winding range, and only then, to form the thread reserve. In the case of spinning without godets, the layers of the padding winding do not qualify as production material, for the reason that, during deposition, the thread had been withdrawn from the spinning zone at a velocity which is not accurately defined and that it therefore exhibits denier variations. However, even in the case of spinning with godets the first layers of the padding winding are frequently damaged—due to the fact that they have been subjected to crushing between the drive roller and the hard sleeve.

The layers of the padding winding therefore fulfill a dual purpose: for one thing they form a throwaway or waste winding and for another they provide a suitable padding for the subsequent layers of production-quality thread material. The layers of the waste winding are preferably deposited by the traversing thread guide of the winding device. Now, in connection with the build-up of the thread reserve the problem arises that the thread after application of the waste winding must be lifted out of the traversing thread guide, transported out of the winding range of the bobbin, deposited in a few layers of thread reserve adjacent to the winding range of the bobbin and then turned back over to the traversing thread guide.

The known auxiliary thread guides for the application of a thread reserve are not suited for the performance of these functions. It is an object of the invention to provide a winding machine with novel and improved means for forming a thread reserve winding at a location axially adjacent to the bobbin to be wound.

More specifically it is an object of the invention to provide a winding machine in which, by way of a traversing thread guide, auxiliary thread guide and then again traversing thread guide, a waste winding is formed within the range of the bobbin, then a thread reserve winding adjacent to the bobbin range, and following this, the bobbin proper—all this without manual intervention.

In accordance with these objects a winding machine is proposed which has a traversing thread guide with a thread-guiding slot projecting into the "traversing veil" or thread traversal plane and with side faces slanted with respect to the thread traversal plane, and has an auxiliary thread guide for forming a thread reserve in a thread reserve zone, axially adjacent the bobbin; and wherein the auxiliary thread guide has an arm or pin extending, with a slant in the direction of the thread reserve zone, into the thread traversal plane and is moved into this zone along a path which extends on the side of the thread opposite the traversing thread guide and at least partially parallel to the path of the last mentioned guide.

This auxiliary thread guide may be driven, for example, by a hydraulic or pneumatic cylinder and piston. By means of this auxiliary thread guide it is possible, if desired, to lift the thread out of the thread guiding slot in any position of the traversing thread guide; transport the thread into the thread reserve zone; in this location form a thread reserve by momentarily arresting the auxiliary thread guide; and then turn the thread back over to the traversing thread guide by retraction of the auxiliary thread guide. The advantage of this auxiliary thread guide resides in that it lifts the thread out of the slot of the traversing thread guide only when the traversing thread guide with the thread therein happens to be on the side facing the thread reserve zone. However, if the traversing thread guide, with the thread, comes from the side opposite to the thread reserve zone, it is driven by the auxiliary thread guide into the slot merely more deeply, rather than being lifted out of the slot.

According to a preferred embodiment of the invention, it is proposed to let the path of the auxiliary thread guide including the above mentioned arm extend at both ends beyond the path of the traversing thread guide, with the normal position of the auxiliary thread guide being provided on the side of the winding device which is opposite to the thread reserve zone.

This arrangement results in a particularly simple construction of the auxiliary thread guide. The parts for moving the auxiliary thread guide are formed merely by the rectilinearly translated piston or rod. Mechanical devices which make it possible to again discharge the thread from the auxiliary thread guide are not required since, because of the central location of the thread feeding means, the thread is not taken along by the auxiliary thread guide beyond the range of the bobbin center. Where, for reasons of space or design limitations, it is not possible to move the auxiliary thread guide over the entire width of the winding machine, it is proposed to solve the underlying problem by making the pin rockable and connecting it with a rocking mechanism in such a way that the pin is rocked into the thread traversal plane only during its movement in the direction of the thread reserve zone. By virtue of this mechanism asymmetrical and, especially, bead-forming deposition of the thread within the winding range of the bobbin is avoided; for any bead-forming or asymmetrical deposition of the thread gives rise to non-uniform contacting of the drive roller and tends to increase slippage of the drive roller on the one hand and crushing of the sensitive material on the other hand. The discharge of the thread from the auxiliary thread guide may be effected, in connection with this auxiliary thread guide, by suitably implementing the rocking movement of the pin out of the thread traversal plane, or, alternatively, by retracting the auxiliary thread guide from the thread reserve zone so fast that the thread cannot keep up with the auxiliary thread guide.

The rocking movement of the pin may take place within the range of the normal position or in the range of the thread reserve. The rocking movement may take place about an axis normal to the translational direction of movement of the pin. Such a rocking movement—in an out-of-the-way direction—within the range of the thread reserve zone is advantageous in order that due to the pin rocking into an out-of-the-way position and the thread slowly sliding off of the pin, a few mutually adjacent thread reserve turns may be formed.

If the rocking movement is to be effected with the rocking axis of the pin lying in its translational direction of movement, pneumatic or hydraulic cylinder-piston units or else electromagnets, are preferably used as translational drives of the auxiliary thread guide, the member carrying the slanted arm being fixedly connected with the moved part of the translational drive and being rockable about the axis of movement of the translational drive by means of a pin sliding in a predetermined guide slot or by similar devices.

The traversing thread guide of the winding machine according to the invention is designed so that it can, itself, capture the non-guided thread disposed in the thread traversal plane. To this end the traversing thread guide is provided with side faces which are slanted with respect to the thread traversal plane. Depending upon the design of the auxiliary thread guide it may be advantageous to design the traversing thread guide in such a way that it can capture the thread only when coming out of one particular direction. For this purpose it is proposed to provide the traversing thread guide on one side with a shorter angularly projecting side face than on the other side. Preferably, the shorter slanted side face is provided on the side facing the thread reserve zone.

The auxiliary thread guide according to the present invention is particularly suited for winding machines designed for the production of two or more bobbins on a single chuck. In this connection it is proposed to provide a plurality of arms or pins corresponding in number to the number of bobbins and mutually spaced along the moved part of the translational drive according to the mutual spacing of the respective thread reserve zones. With such a winding machine the deposition of two or more threads is considerably simplified by letting the two or more threads be captured by only a single thread capturing device which is provided at one end of the chuck. It is proposed to let the path of the above mentioned moved part extend in such a way that the first pin, disposed nearest the thread capturing device, is arranged to travel at both ends beyond the path of the traversing thread device associated therewith and to make it rockable out of the thread traversal plane, at least, at the end of its path which is opposite to the thread capturing device. The first pin thus takes over the distribution of the two threads over the two corresponding bobbin ranges, by carrying the second thread over the first traversing thread guide.

Illustrative embodiments of the invention incorporating these and other features and advantages will now be described with reference to the accompanying drawings, in which;

FIG. 1 is a perspective view of a winding device with an auxiliary thread guide according to the invention;

FIG. 4 shows an advantageous design of a traversing thread guide for use in a winding machine according to this invention;

FIGS. 5*a* and 5*b* are part-views of a further modified design of a winding machine with an auxiliary thread guide which is rockable about its translational axis of movement, FIG. 5*a* being a plan view and FIG. 5*b* a front view taken in the direction of arrows III, FIG. 5*a;*

Figure 7:
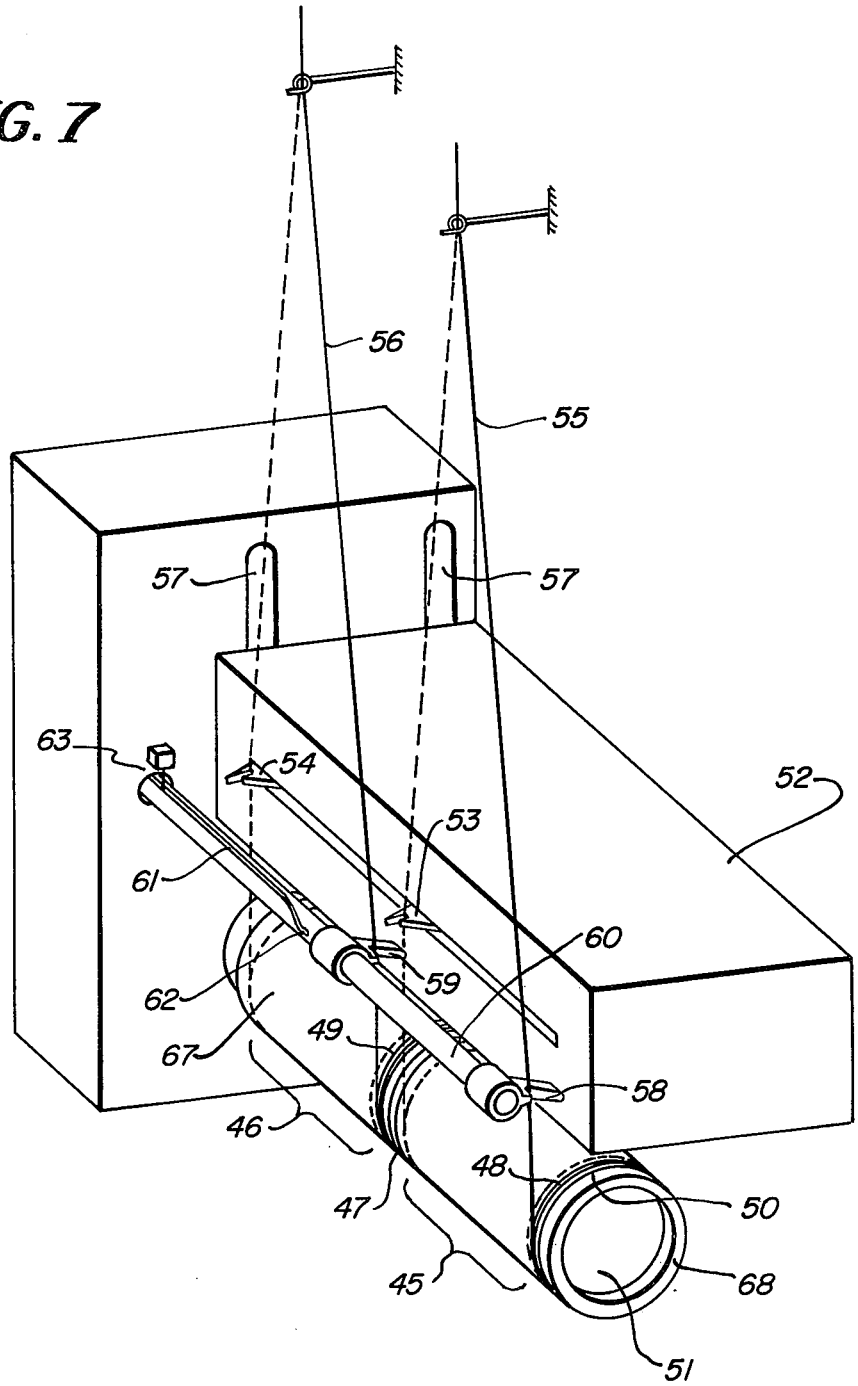

FIG. 6 is a part plan view of a winding machine with an auxiliary thread guide which is rockable in the thread reserve zone;

FIG. 7 is a perspective view of a winding machine according to the invention for the production of two bobbins on a single chuck.

Figure 2:
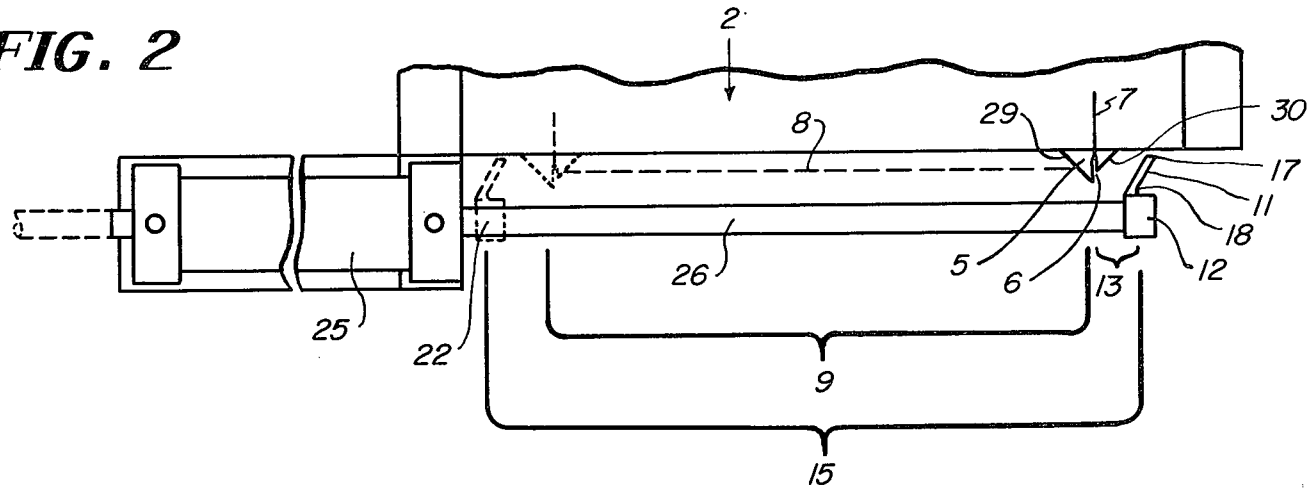
FIG. 2 shows the same winding machine in a plan view taken in direction II, FIG. 1.

The winding machine according to FIGS. 1 and 2, comprises a reciprocating device 2 which consists of a shaft with a reversing-type tracking groove (not visible in these figures) and a traversing thread guide 5 driven thereby, a deflecting roller 27, a bobbin 3 and a drive roller 4 which is driven at a constant speed of rotation. The thread 7 is fed to winding machine 1 over roller 23 and thread guide eyelet 24. Thread 7 is guided in slot 6 of the traversing thread guide 5 and is reciprocated in thread traversal plane 8 over the winding range 9 in such a manner that a cylindrical crosswound bobbin 3 is generated. In the initial phase of the winding operation a thread reserve 14 is formed in a thread reserve zone 13 disposed on sleeve 28.

The winding machine is further provided with an auxiliary thread guiding device. This device comprises a pin 11 which is mounted on a rod 26 by means of a carrying member 12. Rod 26 is moved by a piston (not shown) under fluid pressure in cylinder 25. Pin 11 is supported by carrying member 12 in cantilever fashion and, with its end 17, is slanted in the direction of thread reserve 13. Pin 11 forms with carrying member 12 a groove 18 which is rounded and smoothed so that it is suitable to guide the thread for a short time.

Pin 11 extends into thread traversal plane 8 from one side and slot 6 in traversing thread guide 5 from the other side. Pin 11 is mounted on rod 26 for translation movement over a range designated as 15, from its normal position 22 to the end of thread reserve zone 13.

The operation of the winding machine with the auxiliary thread guide is as follows: At the beginning of the winding operation the incoming thread 7 is placed around deflecting roller 27 and is clamped in a thread capturing slot on the sleeve or between sleeve and chuck or in a filament capturing slot of the chuck. The filament then travels towards the bobbin center, is thus captured in a slot 6 of traversing guide 5 and is deposited, for several layers, on bobbin 3 in crosswound fashion. Subsequently, the auxiliary thread guide is put in operation under the control of means not particularly shown and is moved from its normal position 22 in the direction of thread reserve zone 13 at high speed. In the process, pin 11 infallibly engages the thread 7 which is reciprocated by traversing thread guide 5. Thread 7 slides, along the slanted inside face of pin 11, out of slot 6 of the traversing thread guide 5 and into groove 18. The auxiliary thread guide now takes thread 7 along into the thread reserve zone 13 where a few turns of thread are deposited as a thread reserve 14. A thread length of 0.5 — 1 m for example, is sufficient for this thread reserve. Because of the high thread velocities which occur in spinning, stretching or spin-stretching, this means that pin 11 dwells in thread reserve zone 13 for only a short time. Subsequently, pin 11 travels, first slowly and then with increasing speed, back into its normal position 22. In this travel, pin 11 carries the thread along, at the most up to the center of path 9 of traversing thread guide 5, namely because of the central location of thread guide eyelet 24. At this point, at the latest, the thread slides out of groove 18 to be captured again by traversing thread guide 5 and slot 6, and it is then further deposited as crosswound bobbin 3.

In order to facilitate recapture of the thread, traversing thread guide 5 has side faces or flanks 29 and 30 which are slanted in the direction of movement of the guide.

FIG. 4 shows a preferred embodiment of traversing thread guide 5 for use in winding machines according to the invention. The traversing thread guide comprises a shuttle 33 which is guided in the reversing grooves of a tracking shaft. Connected to the shuttle is a pivot joint 34 in which the front portion of the traversing thread guide 5 is rotatably mounted. The front portion of the traversing thread guide has a guideway 35 which, at the same time, keeps the traversing thread guide from tilting. The front portion is triangularly formed. However, side faces 31 and 32 which are provided adjacent to thread guide slot 6 are not formed symmetrically; instead, side face 31 is longer than side face 32.

When the traversing thread guide engages the thread with its side face 31, the thread is not captured in slot 6, but it jumps over slot 6. On the other hand, when the traversing thread guide engages the thread with side face 32, the thread is captured in slot 6 more safely due to the protruding tip of side face 31. Such a traversing thread guide advantageously supplements and emphasizes the properties of the auxiliary thread guide according to the invention. Its operation will be explained, by way of example, in connection with a winding machine according to FIG. 1. In FIG. 1 the traversing thread guide according to FIG. 4 is disposed in such a way that its long side face is located on the side of slot 6 away from the thread reserve zone.

If this traversing thread guide 5, with the thread therein, overtakes pin 11 coming from the left, the thread on the one hand is pressed by the slanted rear face of pin 11 into slot 6 and in addition is safely guided by the long face of the slot for retention therein. On the other hand, if the thread guided by traversing thread guide 5 engages pin 11 coming from the side of the thread reserve zone, then the thread will slide that much more safely out of slot 6 and on to pin 11, because the slot is shorter on this side. Also, in this design of the traversing thread guide no harm is done if the thread does not slide along pin 11 fast enough and, conceivably, is again contacted by the traversing thread guide 5. For, if the traversing thread guide upon such contact comes from the side of the thread reserve zone, then the thread will not jump into slot 6 of traversing thread guide 5 but will jump over the slot on its long side. This avoids that the thread is excessively deflected between pin 11 and traversing thread guide 5 and is possibly torn. On the other hand, if the traversing thread guide, coming from the other side, contacts the thread, no harm is done because it can take the thread along for only a short time and in its return travel must again turn the thread over to the auxiliary thread guide.

Figure 3:
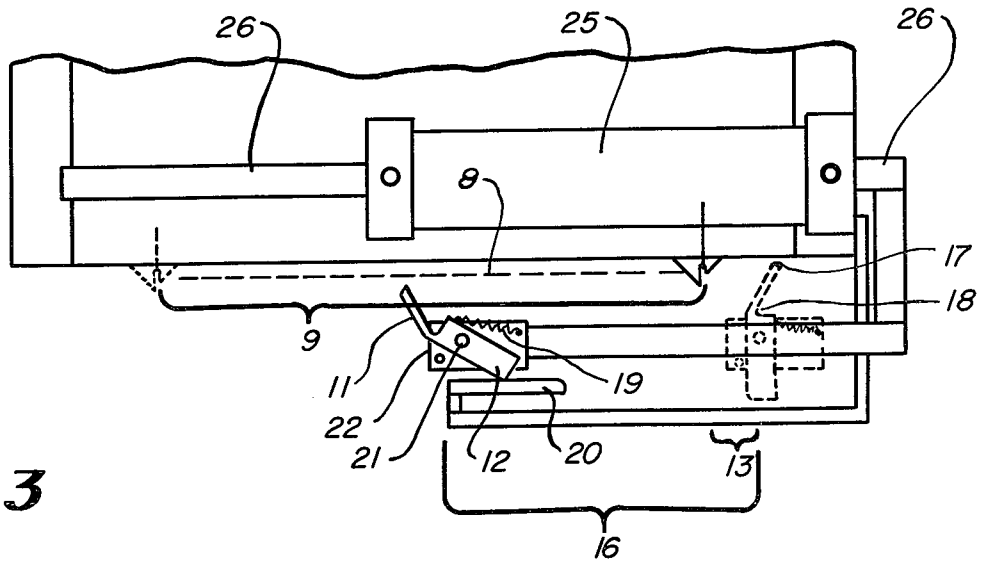
FIG. 3 is a winding machine with a modified design of the auxiliary thread guide according to the invention.

The embodiment of the winding machine according to FIG. 3 is beneficial when space limitations make it impossible to let cylinder 25 and rod 26 project as far outwardly as they do in FIG. 2. The essential feature of the embodiment of FIG. 3, therefore, consists, for one thing, in that in the normal position 22 there are no substantially projecting parts. In addition, this embodiment has the advantage that pin 11 with its carrying member 12 is rockable about an axis 21 in such a way that it can penetrate the thread traversal plane 8 or can be entirely rocked out of this plane. In order to exert a restoring force in the direction of penetration, a restoring spring 19 is provided. Pin 11 is rocked out of the thread traversal plane 8 by means of stop 20 against which carrying member 12 travels before moving into its normal position 22. Stop 20 has a predetermined length.

The operation of this embodiment is as follows: Subsequent to the starting of the thread and the formation of a few layers of thread as described above in conjunction with FIGS. 1 and 2, the auxiliary thread guide is set in motion at a high speed. At this time carrying member 12 still slides over stop 20. Stop 20 has such a length that the auxiliary thread guide is already at its maximum velocity when pin 11 penetrates the thread traversal plane. This maximum velocity, though, is still sufficiently low that the traversing thread guide 5, in any event, is able to catch up again with the auxiliary thread guide. If the traversing thread guide 5 catches up with pin 11 from behind, then the thread at the slanted rear face of pin 11, is only pressed into slot 6 more deeply and is not lifted out of traversing thread guide 5. However, if the traversing thread guide 5 comes from in front, then the thread, at the slanted front face of pin 11 slides out of slot 6 and into groove 18.

Subsequently, the thread reserve winding 14 having a thread length of a few meters is produced in zone 13, since, as shown in FIG. 3, the range of movement 16 of the auxiliary thread guide extends this much to the right. Following this, pin 11 returns at increasing velocity into its normal position 22 and, shortly before reaching normal position 22—which is located near the center of winding range 9—it again rocks out of the thread traversal plane 8 and releases the thread. The thread is then captured again by the traversing thread guide 5, as described above.

FIGS. 5*a* and 5*b* show a winding machine with a projecting support 36. Mounted on this support 36 is a pneumatic cylinder 37. In this case, the auxiliary thread guide consists of a pin 11 and of carrying member 12 which is fixedly connected with piston rod 39 and piston 38. Piston 38 is rotatable with all parts affixed thereto. The rotational movement is produced by guide groove 40 through which pin 11 extends, that is, in this implementation pin 11 is designed to rock about an axis 64 lying in the translational direction of movement of the pin, rather than about an axis normal thereto as in FIG. 3. This embodiment is kinematically very simple and advantageous. Its operation in most respects is similar to that described above in connection with FIG. 3.

FIG. 6 shows a part-view of a further modification of the winding machine according to the invention. The figure illustrates part of the reciprocating device 2 of the winding machine with the traversing thread guide 5 in one of its end positions. On rod 26 there is provided a carrying member in the form of a friction wheel 41 with the pin 11. The friction wheel is pressed against stop 42 by means of spring 43. The piston rod 26 may be driven in any desired fashion, for example, in the manner shown in FIGS. 1, 2, 3, 5. It will be noted, however, that in the embodiment shown in FIG. 6 the thread passes from the traversing thread guide to the auxiliary thread guide always at a point near the right hand end of winding range 9 as will now be described.

In the range of thread reserve zone 13 friction wheel 41 cooperates with a resilient bracket 44 which is mounted on the machine frame. In this manner, in response to movement of piston rod 26 from its normal, extreme left position to the right and the corresonding rocking movement of pin 11 in the clockwise direction, the thread is captured by the slanted right face of pin 11 as the pin penetrates the thread traversal plane. On the return movement of piston rod 26 the ensuing counterclockwise movement of pin 11 permits the thread to be released from the pin and recaptured by thread traversing guide 5. By making the return movement slow, the rocking movement can be slowed down correspondingly so that the thread may slowly slide down the pin 11 and may thus be deposited in a few mutually adjacent turns of thread reserve. It may be noted that in FIGS. 1 to 6 corresponding parts carry the same designations.

FIG. 7 shows a winding machine for the production of two bobbins on two sleeves 67 and 68 provided on chuck 51. The bobbin ranges are designated as 45 and 46. On each sleeve there is provided adjacent the bobbin range a corresponding thread reserve zone 48 and 49. In lieu of the two sleeves 67 and 68 a single long sleeve may be used which is provided with a separating groove along which the sleeve may be separated subsequent to the production of the bobbins. At the beginning of sleeve 68 there is provided a thread capturing groove 50 which extends over the entire circumference or over a part of the circumference. Both threads 55 and 56 can be captured in this thread capturing groove 50. The auxiliary thread guide according to this invention comprises a translationally moved rod 60 on which pins 58 and 59 are mounted. Rod 60 also is provided with a groove 61 having a curved portion at its end 62. Travelling in the same groove 61 is a pin 63. In this manner rod 60 in its translational movement is also rocked about its axis. The traversing device consists of a traversing slide 52 in which there is provided a tracing shaft with two reversing grooves (not shown). The reversing threads serve to drive traversing thread guides 53 and 54. Traversing slide 52 is moved vertically in guideways 57 and, by means of contacting or non-contacting sensing devices not shown or by means of a given program, kept at a predetermined distance with respect to the bobbin surface.

The threads are laid down and the thread reserves produced in the following manner: the two threads 55 and 56 are jointly inserted into groove 50. At this time rod 60 with pins 58 and 59 is in the position shown. Both threads run over pin 58. Now rod 60 is retracted to a point where pin 58 is positioned beyond the bobbin range 45. Due to the design of groove 61, rod 60 is rocked together with pins 58 and 59. The first thread 55 has already been held up in the center of the bobbin range 45 and has been captured there by traversing thread guide 53. The second thread 56 is safely carried by pin 58 over the groove 47 between the two sleeves 67 and 68; only then does it slide off pin 58 when the latter is being rocked downwardly and it is now engaged by traversing thread guide 54. Both threads are then deposited in traversing ranges 45 and 46, respectively, in the form of a few layers of a waste winding. Subsequently, rod 60 advances again, rocks, due to the design of groove 61, pins 58 and 59 into the thread traversal plane and thereby grips threads 55 and 56 by means of pins 58 and 59 respectively. The threads are deposited in the thread reserve zones 48 and 49 in a few turns of a thread reserve. Thereafter, rod 60 is again retracted whereby the threads are released in the center of the respective bobbin ranges 45 and 46 and are again engaged by the respective traversing thread guides 53 and 54.

The devices described herein insure that no bulges or beads are formed on the bobbin in the deposition of the thread. This is of particular importance in winding machines driven by a drive roller (e.g., FIG. 1), since, considering the high thread velocities and winding velocities of, e.g., more than 3,000 m/min., any asymmetrical deposition of thread material within the bobbin range leads, due to drive roller 4, to such high friction and pressure stresses of the sensitive thread material that the thread material may be caused to melt or at least be damaged.

From the embodiments shown it is evident that the principle of the invention can also be materialized in other designs. In particular, variations are conceivable with respect to the location of normal position 22 and the rocking of pin 11 and carrying member 12.

The particular advantage of the invention resides in that the auxiliary thread guide is very simple designwise and kinetically and that it may readily be used in many modifications adapted to the design of the winding machine and the winding task at hand. It may be mentioned that the production of the so-called padding or waste winding is not a prerequisite for the use of the winding machine with the auxiliary thread guide according to the invention.

The invention is hereby claimed as follows:

1. In a winding machine the combination including:

a traversing thread guide of substantially flat triangular shape, said guide extending into the thread traversal plane from one side thereof, being mounted for rectilinear reciprocating movement only, along a path parallel to said plane, having a thread-guiding slot opening into the thread traversal plane and two external side faces slanted towards the mouth of said slot, one of said slanted side faces being shorter than the other;

an auxiliary thread guide for lifting the thread out of said slot to form a reserve zone axially adjacent to the bobbin being wound, said auxiliary thread guide having an arm extending into the thread traversal plane from the opposite side thereof, and means for moving said auxiliary thread guide, along a path extending on said opposite side at least partially parallel to the path of the traversing thread guide, into the thread reserve zone at a speed lower than the reciprocating speed of said traversing thread guide;

said arm of the auxiliary thread guide, with its free end, pointing at an acute angle in the direction of the thread reserve zone to provide a correspondingly slanted rear face, a correspondingly slanted front face and a recess at the root of said front face, said rear face being shaped so as to retain the thread in the slot of said traversing thread guide when the traversing thread guide, moving in the direction of said thread reserve zone, overtakes said auxiliary thread guide from the rear, and said front face being shaped so as to lift the thread out of said slot and capture it in said recess when the traversing thread guide, moving in the direction away from said thread reserve zone, passes said auxiliary thread guide from in front, and said retaining of the thread in the slot and lifting of the thread out of the slot being aided by the greater and lesser length, respectively, of said two side faces of said traversing thread guide.

2. In a winding machine the combination as claimed in claim 1 wherein the path of said auxiliary thread guide overlaps only partially the path of said traversing thread guide, wherein said arm is mounted for rocking movement with respect to said moving means, and wherein there are provided means for controlling said rocking movement in such a way that said arm is rocked into the thread traversal plane only during its movement in the direction of the thread reserve zone.

3. In a winding machine the combination as claimed in claim 2 wherein said auxiliary thread guide is mounted for rocking movement about an axis normal to the longitudinal axis of said moving means.

4. In a winding machine the combination as claimed in claim 2 wherein said auxiliary thread guide has a hub extending coaxially with and being fixedly connected to said moving means and mounted for rocking movement with said moving means about the longitudinal axis thereof.

5. In a winding machine the combination as claimed in claim 2 wherein said controlling means comprise cam means rocking said arm into the thread traversal plane at a location within the winding range defined by the stroke of said traversing thread guide.

6. In a winding machine the combination as claimed in claim 2 wherein said controlling means comprise cam apparatus rocking said arm into the thread traversal plane at a location near the thread reserve zone.

7. In a winding machine for the production of two or more bobbins on a single chuck the combination as claimed in claim 1 wherein there are provided a plurality of auxiliary thread guides corresponding in number to the number of bobbins, the arms of said auxiliary thread guides being mutually spaced along said moving means according to the mutual spacing of the respective thread reserve zones.

8. In a winding machine the combination as claimed in claim 7 wherein there is provided a thread capturing device at one end of said chuck, wherein said moving means is designed for translation in such a way that the path of the arm disposed nearest said capturing device extends at both ends beyond the path of the corresponding traversing thread guide and wherein there are provided means for rocking said arm out of the way at that end of its path which is opposite to the thread capturing device.

* * * * *